United States Patent [19]

Payton

[11] 4,150,486

[45] Apr. 24, 1979

[54] DRAWING COMPASS

[75] Inventor: Raymond A. Payton, Bewdley, England

[73] Assignee: Helix International Limited, W. Midlands, England

[21] Appl. No.: 809,125

[22] Filed: Jun. 22, 1977

[30] Foreign Application Priority Data

Jun. 29, 1976 [GB] United Kingdom ..... 26952/76
Nov. 19, 1976 [GB] United Kingdom ..... 48257/76

[51] Int. Cl.[2] ..... B43L 9/24
[52] U.S. Cl. ..... 33/27 B; 33/149 H
[58] Field of Search ..... 33/27 B, 149 H, 152 B; 151/22, 2 A

[56] References Cited

FOREIGN PATENT DOCUMENTS 194 of 1913 United Kingdom ..... 33/149 H
1261866 1/1972 United Kingdom ..... 33/27 B

*Primary Examiner*—Charles E. Phillips

*Attorney, Agent, or Firm*—Neil F. Markva

[57] ABSTRACT

A drawing compass has mounted on a projecting stub an internally screw-threaded clamping nut which is for clamping a pencil, ball-point pen, or the like in place in the stub. The nut is held captive on an external screw thread on the stub by stop means at the inner and outer ends of the external screw thread. The clamping nut is composed of plastics material sufficiently resilient to permit the nut, during assembly of the compass, to be moved past one of the stop means at an end of the external screw thread and sprung into operative engagement with the said thread. The stub may be die-cast and have an unthreaded outer portion having an inner end which is adjacent to the outer end of the external screw thread. The inner end constitutes the stop means for the clamping nut at the outer end of said thread. The stub also has an unthreaded inner portion having an outer end which is adjacent to the inner end of the external screw thread. The outer end constitutes the stop means for the nut at the inner end of said thread.

10 Claims, 5 Drawing Figures

DRAWING COMPASS

This invention relates to drawing compasses of that kind (hereinafter called "the kind referred to") wherein the compass comprises a leg having a pointed element at one end and pivoted at its other end to one end of a shank of an arm. The shank has at its other end a laterally-projecting stub or barrel which has an external screw thread thereon and is formed with a socket hole suitable for receiving a pencil, ball-point pen, or the like.

There are known arrangements of a clamping ring on a stub or barrel of a compass arm. However, a child may (unless the stub or barrel is upset or otherwise provided with stop means after the ring is in place) without difficulty remove the ring from the stub or barrel and may lose the ring or cross-thread it with the external screw thread in an attempt to replace it.

An object of the invention is to provide a drawing compass which is of a construction such as to enable it to be inexpensively and robustly made as a mass-produced article suitable for use by, for example, school children.

SUMMARY OF THE INVENTION

According to the invention, a drawing compass, of the kind referred to, has an internally screw-threaded clamping ring or nut threadingly engaging an external screw thread on the projecting stub or barrel. The ring clamps the pencil, ball-point pen, or the like, in place in the stub or barrel. The clamping ring is held captive on the external screw thread of the stub or barrel by stop means located at the inner and outer ends of said external screw thread. The ring or nut is composed of plastics material sufficiently resilient to permit the ring or nut, during assembly of the compass, to be moved past one of the stop means and sprung into operative engagement with the external screw thread.

With an arrangement in accordance with the present invention, it is difficult or impossible for a child to remove the ring or nut from the stub or barrel after the ring or nut has been sprung into place in manufacture of the compass. It is not necessary to carry out an upsetting or other stop-forming operation on the stub or barrel after the clamping ring or nut is in place.

The inner end of the stub or barrel may be so fashioned, and the clamping ring or nut be sufficiently resilient, to permit the ring or nut, during assembly of the compass, to be passed from the shank of the arm onto the stub or barrel and to be moved past the stop means at the inner end of the external screw thread and then sprung into operative engagement with said screw thread. The shank of the arm and the stub or barrel may together constitute a one-piece die-cast unit. The external screw thread and the stop means may be formed during a single die-casting operation.

The stub or barrel may have an unthreaded outer portion having an inner end which is adjacent to the outer end of the external screw thread. This inner end constitutes the stop means for the ring or nut at the outer end of said thread. The stub or barrel may have an unthreaded inner portion having an outer end which is adjacent to the inner end of the external screw thread. This outer end constitutes the stop means for the ring or nut at the inner end of said external screw thread. If desired the arrangement may be such as to permit the clamping ring or nut, during assembly of the compass, to be sprung over the outer end of the stub or barrel whereby to move past the stop means at the outer end of the external screw thread and sprung into operative engagement with said external screw thread.

The invention includes a method of producing a drawing compass of the kind referred to wherein the shank of the arm of the compass is die-cast in one piece with the stub or barrel. The stub or barrel is formed during the die-casting thereof with the external screw thread having stop means at the inner and outer ends of said thread. The clamping ring or nut is made of resilient plastics material and is, after the arm has been die-cast, moved by a tool past one of the stop means at an end of the external screw thread and sprung into operative engagement with said external screw thread.

BRIEF DESCRIPTION OF DRAWINGS

In the accompanying drawings which show, by way of example, a drawing compass constructed in accordance with the invention.

DESCRIPTION OF SPECIFIC EMBODIMENTS

Figure 1:
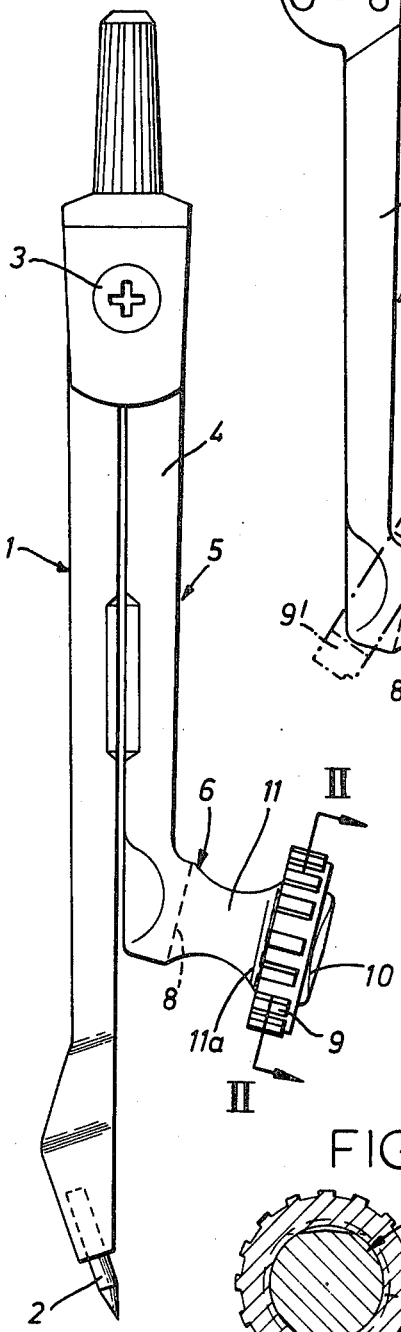
FIG. 1 is a front view of a compass.

Referring to the drawings, a drawing compass comprises a die-cast metal leg 1 having a pointed element 2 at its one end and being pivoted at its other or inner end, by means of a pivot screw 3, to inner end section **4*a*, of a shank 4 of a die-cast arm 5. Shank 4 has at its other or outer end an integral laterally-projecting stub or barrel 6 which has an external screw thread 7 thereon. Barrel 6 includes a socket hole 8 for receiving a pencil or the like. An internally screw-threaded knurled resilient plastics clamping ring 9 is mounted on the stub or barrel 6 and is operatively engaged with the external screw thread 7. Ring 9 is held captive on the thread 7 and is effective to clamp the pencil or the like in place in the socket hole 8 of stub or barrel 6**.

The stub or barrel 6 has an unthreaded outer portion 10 having an inner end **10*a* immediately adjacent to the outer end of the external screw thread 7. Inner end 10*a* constitutes stop means, at the outer end of the thread 7, for holding the ring 9 captive against removal in an outwards direction from the thread 7. Barrel 6 has an unthreaded inner portion 11 having an outer end 11*a* immediately adjacent to the inner end of the thread 7. Outer end 11*a* constitutes stop means, at the inner end of the thread 7, for holding the ring 9 captive against removal in an inwards direction from the thread 7. The overall diameter of unthreaded inner portion 11 decreases slightly in a direction towards the outer end of shank 4**.

Figure 3:
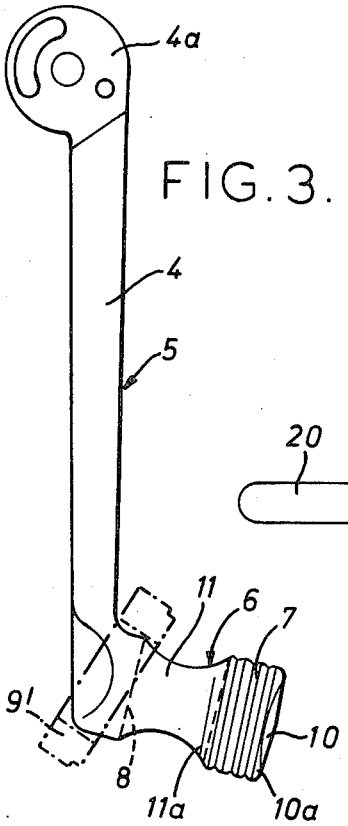
FIG. 3 shows an arm, of the compass, shown in FIG. 1, having a stub or barrel at its outer end, before a clamping ring or nut is operatively engaged with the stub or barrel.

As is evident in the drawings, a sufficient portion of the screw thread 7 is disposed inwards of the outer extremity (shown by the right-hand dashed line in FIG. 3) of the socket hole 8 to enable the ring 9, when mounted on said thread 7, to be clamped firmly against a pencil, inserted in the socket hole 8. The pencil would have a slightly less overall cross-sectional width than that of hole 8.

Figure 4:
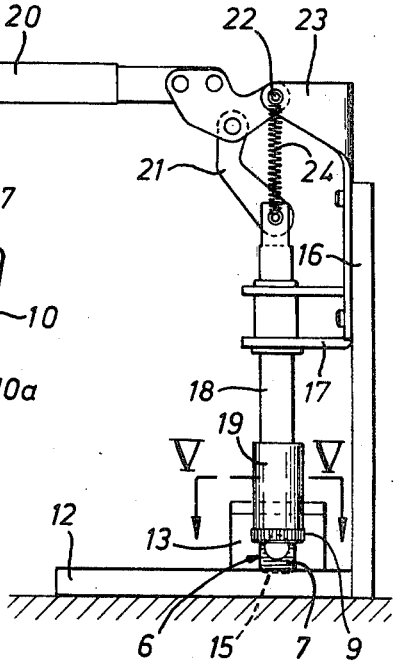
FIG. 4 shows, by way of example, a tool for use in attaching a clamping ring or nut to the screw thread on the stub or barrel shown in FIG. 3.
Figure 2:
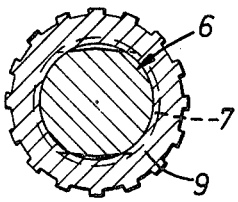
FIG. 2 is a cross-section on the line II—II, FIG. 1.
Figure 5:
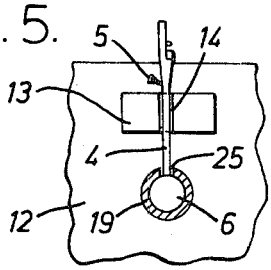
FIG. 5 is a section on the line V—V, FIG. 4.

Arm 5 comprises shank 4 and the stub or barrel 6 with its thread 7 having unthreaded portions 10, 11 providing stop means 10*a*, 11*a*. Arm 5 is formed in one piece in a single die-casting operation. Resilient plastics ring 9 is introduced onto the shank 4 over the inner end section 4*a* thereof, before arm 5 is pivotally connected to the leg 1. Ring 9 is tilted and then passed from the shank 4 to the stub or barrel 6, as indicated in broken lines at 9' in FIG. 2. A suitable tool, as shown in FIGS. 4 and 5, is used to forceably push ring 9 over the unthreaded inner portion 11 of the stub or barrel 6. Thus, ring 9 moves past the stop means 11*a* at the inner end of the external screw thread 7 and springs into operative engagement with said thread 7.

The tool shown in FIGS. 4 and 5 comprises a metal base 12 provided with a metal block 13 having an upwardly-presented slot 14 (FIG. 5) for receiving the shank 4 of the arm 5 of the compass. Said base 12 has a circular locating recess 15 for receiving the outer end of the stub or barrel 6 when the shank 4 is engaged with the slot 14. A metal upright 16 has a bracket 17 in which is slidable a vertical metal plunger comprising a rod 18 provided at its lower end with a co-axial cylindrical metal sleeve 19 aligned with the recess 15. Handle 20 is connected to plunger rod 18 via a toggle link 21. The handle 20 is pivoted at connection 22 to a bracket 23 carried by the upright 16. A coiled tension spring 24 is connected between the plunger and the bracket 23.

In use, ring 9 and arm 5 are positioned beneath the open lower end of the sleeve 19 as shown in FIGS. 4 and 5. Barrel 6 is in register with the lower end of sleeve 19. Handle 20 is pulled down, against the action of the spring 24, whereby the plunger 18, 19 moves down and the lower end of sleeve 19 forces ring 9 into place on the screw thread 7. Handle 20 is then moved back upwards and arm 5, with the ring 9 now in place, is removed. A slot 25 in sleeve 19 provides clearance between the sleeve 19 and the shank 4 when the sleeve is pushing the ring 9 into place.

In an alternate method, ring 9 may be sprung into place from the opposite direction onto barrel 6 by pushing it with a suitable tool. A tool similar to that shown in FIGS. 4 and 5 may be used. However, the tool base and the block thereon would be modified to hold arm 5 in a position in which the outer end of the stub or barrel 6 is presented vertically upwards instead of downwards. Ring 9 is forceably pushed over the unthreaded outer portion 10 of the stub or barrel 6 moving past stop means 10*a* at the outer end of the screw thread 7 and then springs into operative engagement with thread 7. The outer end 10 of the stub or barrel 6 may be tapered slightly in an outwards direction to provide a lead for the ring 9 when the latter is being so sprung into place.

The compass shown is of a neat and robust construction which can be inexpensively manufactured by mass production. Removal of the ring 9 from the thread 7 by a child is difficult or impossible, and no upsetting or other operation on the stub or barrel 6 is required after the ring 9 has been sprung into place on the thread 7.

The member 9 may be of any suitable resilient plastics material, for example, acetal.

I claim:

1. A drawing compass comprising:

(a) a leg having a pointed element at one end thereof and an arm pivotally connected to said leg, (b) said arm including a stub and a shank having a free end, said stub projecting laterally from said free end of said shank, (c) said stub having an external screw thread portion and an unthreaded portion thereon and including a socket hole located partially in said thread and unthreaded portions, said hole being suitable for receiving a pencil, ball-point pen, or the like, (d) inner and outer stop means located at the inner and outer ends, respectively, of said external screw thread, and (e) an internally screw threaded clamping nut composed of a resilient material and being threadingly engaged with said external screw thread, (f) said clamping nut being effective to clamp said pencil, ball-point pen, or the like, in said hole, (g) said clamping nut being held captive on said external screw thread by said stop means at the inner and outer ends of said thread, (h) said resilient material being sufficiently resilient to permit said nut, during assembly of the compass, to move past one of said stop means and spring into operative engagement with said external screw thread.

2. A drawing compass as defined in claim 1 wherein the inner end of the stub includes an inner unthreaded portion to permit said nut, during assembly of the compass, to be passed from the shank of the arm onto the stub and to be moved past the stop means at the inner end of the external screw thread.

3. A drawing compass as defined in claim 1 wherein the shank of the arm and the stub together constitute a one-piece die-cast unit.

4. A drawing compass as defined in claim 3 wherein the external screw thread and the stop means at the inner and outer ends of said thread are formed in a single die-casting operation.

5. A drawing compass as defined in claim 1 wherein said unthreaded portion includes an outer unthreaded portion having an inner end which is adjacent to the outer end of the external screw thread, said inner end of the outer unthreaded portion constitutes the outer stop means for the clamping nut at the outer end of said external thread, and said unthreaded portion includes an inner unthreaded portion having an outer end which is adjacent to the inner end of the external thread, said outer end of the inner unthreaded portion constitutes the inner stop means for said nut at the inner end of said external thread.

6. A drawing compass as defined in claim 1 wherein the unthreaded portion includes an outer unthreaded portion effective to permit the clamping nut, during assembly of the compass, to be sprung over the outer end of the stub whereby to move past the stop means at the outer end of the external screw thread.

7. A drawing compass as defined in claim 1 wherein said resilient material is a resilient plastics material.

8. A method of producing a drawing compass comprising a leg having a pointed element at one end thereof and an arm pivotally connected to said leg, said arm including a stub and a shank having a free end, said stub projecting laterally from said free end of said shank, said stub having an external screw thread portion and an unthreaded portion thereon and including a socket hole located partially in said thread and unthreaded portions, said hole being suitable for receiving a pencil, ball-point pen, or the like, inner and outer stop means located at the inner and outer ends, respectively, of said external screw thread, and an internally screw threaded clamping nut composed of a resilient material and being threadingly engaged with said external screw thread, said clamping nut being effective to clamp said pencil, ball-point pen, or the like, in said hole, said clamping nut being held captive on said external screw thread by said stop means at the inner and outer ends of said thread, said resilient material being sufficiently resilient to permit said nut, during assembly of the compass, to move past one of said stop means and spring into operative engagement with said external screw thread, said method comprising the steps of:

(a) die-casting the shank of the arm of the compass in one piece with the stub, (b) forming said stub during the die-casting thereof with the external screw thread and with said stop means at the inner and outer means of said external thread, (c) moving the clamping nut of resilient material with a tool past one of said stop means at an end of the external screw thread to spring said nut into operative engagement with said external screw thread.

9. A method as defined in claim 8 wherein the nut is moved past said stop means at the inner end of said external screw thread.

10. A method as defined in claim 8 wherein the nut is moved past said stop means at the outer end of the stub over the outer end of the external screw thread.

* * * * *